US007131517B1

(12) United States Patent
de Asis Mateo Mur

(10) Patent No.: US 7,131,517 B1
(45) Date of Patent: Nov. 7, 2006

(54) GRADUAL CATCH SYSTEM FOR A BIDIRECTIONAL SAFETY DEVICE

(75) Inventor: Francisco de Asis Mateo Mur, Pina de Ebro (ES)

(73) Assignee: Dynatech Dynamics & Technology, S.L., Pina de Ebro (ES)

( * ) Notice: Subject to any disclaimer, the term of this patent is extended or adjusted under 35 U.S.C. 154(b) by 0 days.

(21) Appl. No.: 11/175,324

(22) Filed: Jul. 7, 2005

(30) Foreign Application Priority Data

May 9, 2005 (EP) ..... 05381021

(51) Int. Cl.
*B66B 5/12* (2006.01)

(52) U.S. Cl. ..... 187/370; 187/356; 187/373; 187/414; 188/43; 188/250 R; 188/382

(58) Field of Classification Search ..... 187/350, 187/356, 363, 364, 367, 370; 188/43, 250 R
See application file for complete search history.

(56) References Cited

U.S. PATENT DOCUMENTS 2,716,467 A * 8/1955 Callaway ..... 187/376
4,093,042 A * 6/1978 Pradon ..... 188/67
5,224,570 A * 7/1993 Fromberg ..... 187/376
5,950,768 A * 9/1999 Gensike et al. ..... 187/376
6,758,310 B1 * 7/2004 Muff et al. ..... 187/370
2004/0149524 A1 * 8/2004 Mori et al. ..... 187/373

* cited by examiner

*Primary Examiner*—Kathy Matecki
*Assistant Examiner*—Stefan Kruer
(74) *Attorney, Agent, or Firm*—Birch, Stewart, Kolasch & Birch, LLP

(57) ABSTRACT

A bi-directional safety mechanism used in an elevator safety device and which produces a gradual catch on a guide rail. The bi-directional safety device has a roller and two hinged rectangular frames, each having a friction element. One hinged rectangular frame is disposed above the roller and the other hinged rectangular frame is disposed below the roller with both hinged rectangular frames on the same side of the guide rail. In addition, a set of fixed brakes are disposed on the other side of the guide rail and opposite to the hinged rectangular frames, preventing this system from marking the guide rail during the braking process.

3 Claims, 3 Drawing Sheets

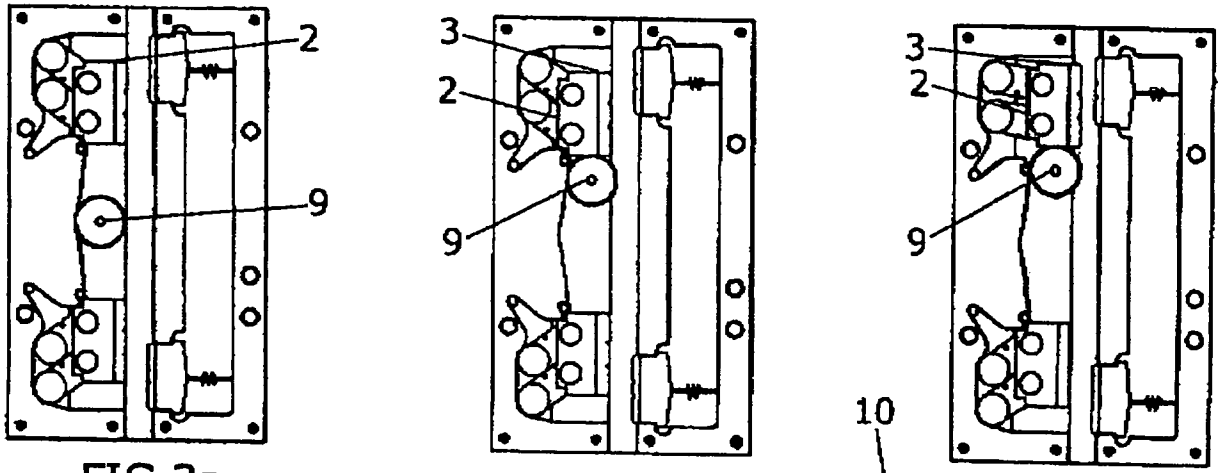
FIG.2a
FIG.2b
FIG.2c
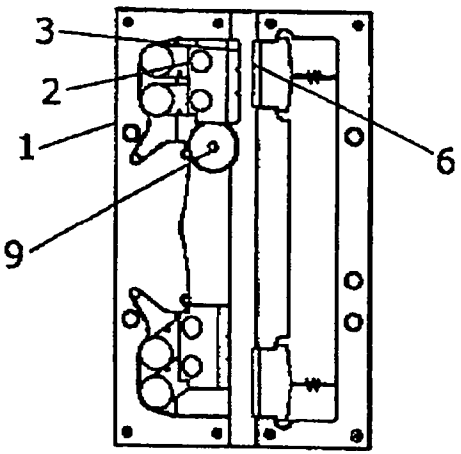
FIG.2d
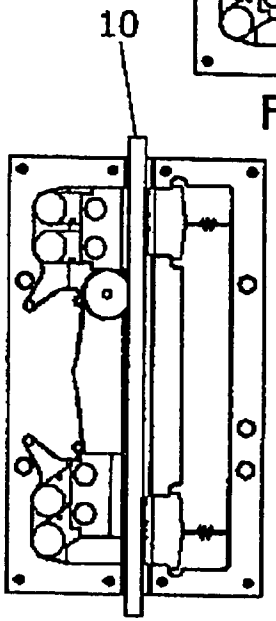
FIG.2e

GRADUAL CATCH SYSTEM FOR A BIDIRECTIONAL SAFETY DEVICE

OBJECT OF THE INVENTION

The object of the present invention is a gradual catch system for a bi-directional safety device for elevators. This is, it relates to a system that allows braking against the elevator guiderails, both in an upwards and downwards direction.

The present invention is characterised by the elements comprising the catch system, which consists of a set of hinged rectangular frames in combination with a roller, so that when the guiderail is pinched the roller does not mark the guiderail much.

Similarly, the present invention is characterised in that it allows using the hinged rectangular frames, which support the mobile shoe, on both sides of the guiderail.

Therefore, the present invention lies within the field of systems or means used for braking elevators against their guiderails, both in an upwards and downwards direction, known in the field as safety devices.

BACKGROUND OF THE INVENTION

Some prior safety devices of elevators are based on the use of a fixed clamp and a mobile clamp and require means for releasing the mobile clamp.

In general, these and other catch systems for safety devices have the drawback that the pressure exerted on the guiderail, in combination with the manner in which it is exerted, tends to mark said guiderail.

Marks left in the elevator guiderails are not received well by manufacturers and installers, due to subsequent effects on the operation of the safety device.

Therefore, the object of the present invention is to develop a gradual catch system for an elevator that allows bi-directional braking, both in an upwards and downwards direction, wherein said braking takes place so that the mark left on the guiderails by the rollers is as small as possible, since after a certain time they stop acting and no longer mark the guiderail during braking.

DESCRIPTION OF THE INVENTION

The invention taught for a gradual catch system for a bi-directional elevator safety basically consists of a roller set and a hinged rectangular frame disposed both above and below the location of the roller.

The catch process begins with the displacement of the roller until it meets one of the two hinged rectangular frames, during which process the roller will mark the guiderail.

The hinged rectangular frame will move gradually, increasingly pressing against the guiderail. The displacement of the frame will continue until it meets the block assembly, at which time the mobile shoe will brake against the guiderail instead of the roller.

The mobile shoe of the hinged rectangular frame will therefore brake the elevator guiderail in combination with a fixed shoe.

The aforementioned frame is comprised of a mobile shoe, joined to a friction element to form an assembly on which are pins joined to corresponding rotation cams at one end, and joined at their other end to rotation hinges.

This gradual catch system avoids marking the guiderails by the rollers, as these only mark the guiderail at the start, until the hinged rectangular frames jut out more and catch the guiderail.

DESCRIPTION OF THE DRAWINGS

To complete the description provided below and in order to aid a better understanding of its characteristics, the present specification is accompanied by a set of drawings whose figures represent the most significant details of the invention for purposes of illustration only and in a non-limiting manner.

FIGS. 2*a* to 2*e* show the successive displacement of the roller and the hinged rectangular frame, showing the gradual catching process involved.

PREFERRED EMBODIMENT OF THE INVENTION

A preferred embodiment of the bi-directional safety device for elevators of the invention is described with reference to the figures.

Figure 1B:
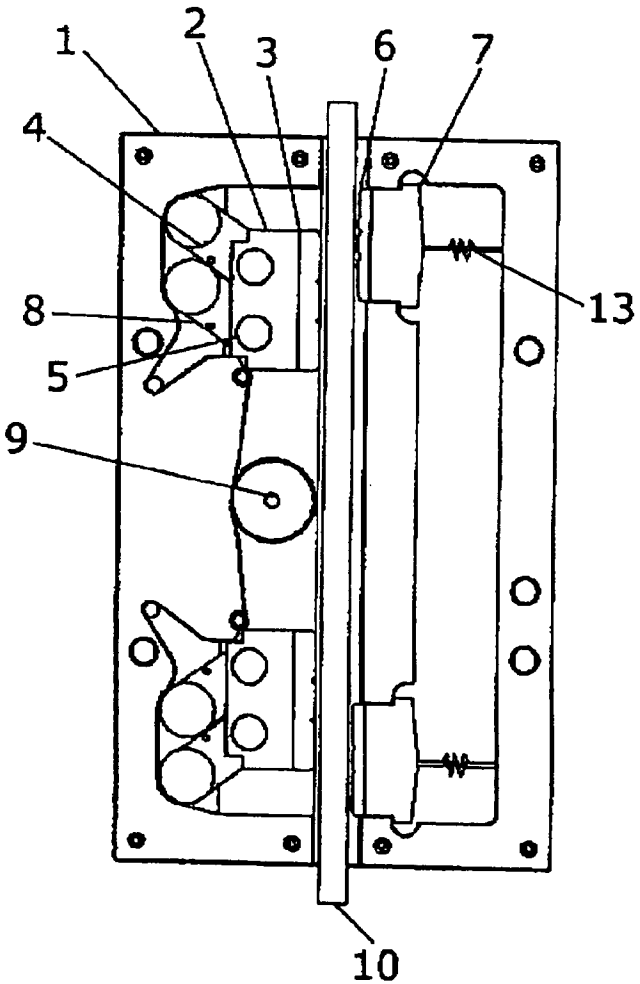
FIG. 1*b* shows a front view of the inside of the gradual catch system.
Figure 1A:
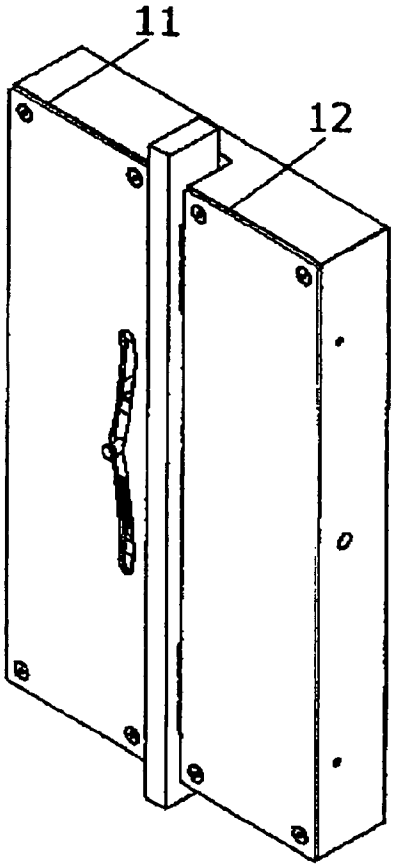
FIG. 1*a* shows a perspective of the catch block for the safety device object of the invention.

FIGS. 1*a* and 1*b* show the elements involved in the gradual catch system for a bi-directional gradual safety device, allowing to identify the block (1) that houses all the catch elements, the base of the mobile shoe (2), to which a friction element (3) of the mobile shoe is attached and the roller (9).

On the mobile shoe (2) are pins (5) about which is hinged one of the ends of rotation cams (8), the other end being joined to rotation hinges (4) so that the assembly forms a hinged rectangular frame.

Also shown is a set of fixed shoes (6) joined to shoe bases (7) and supported by an element that counteracts the force of gravity, such as a spring (13) or metallic strips or rings.

The guiderail (10) runs in the space between the mobile shoe (3) and the fixed shoe (6).

The block (1) is protected on the front by a protection plate (11) and a protection plate for the sheets (12).

FIGS. 2*a* to 2*e* show the various stages of the catching process and the action of the various elements composing the system.

Stage a) shows the roller (9) in its rest position together with the hinged rectangular frame. In the stage labelled b) when catching begins the roller (9) moves until it meets the base of the mobile shoe (2), so that the friction element (3) will travel parallel to the guiderail until it meets the guiderail (10), initiating the braking action.

In stages c) and d) the displacement of the roller (9) continues to push the frame of the mobile shoe (2) until it stops against the block (1) (stage d)). During this process, the roller (9) will be marking the guiderail (10) until the friction element (3) extends beyond the roller (9) due to the movement of the hinged rectangular frame and the roller (9).

Finally, in stage e) the roller (9) is housed between the block (1) and the base of the shoe (2), so that the roller (9) no longer marks the guiderail (10) as it does not exert any braking action on it.

In this situation the braking is effected by the friction between the friction element (3) of the mobile shoe and the fixed shoe (6).

The elements effecting the braking action when the elevator is moving upwards must be anchored by an element (a spring, metal strip, ring or the like) that counteracts the force of gravity and stops them from catching each other in the rest position and allows them to effect the braking action without problems.

Figure 3:
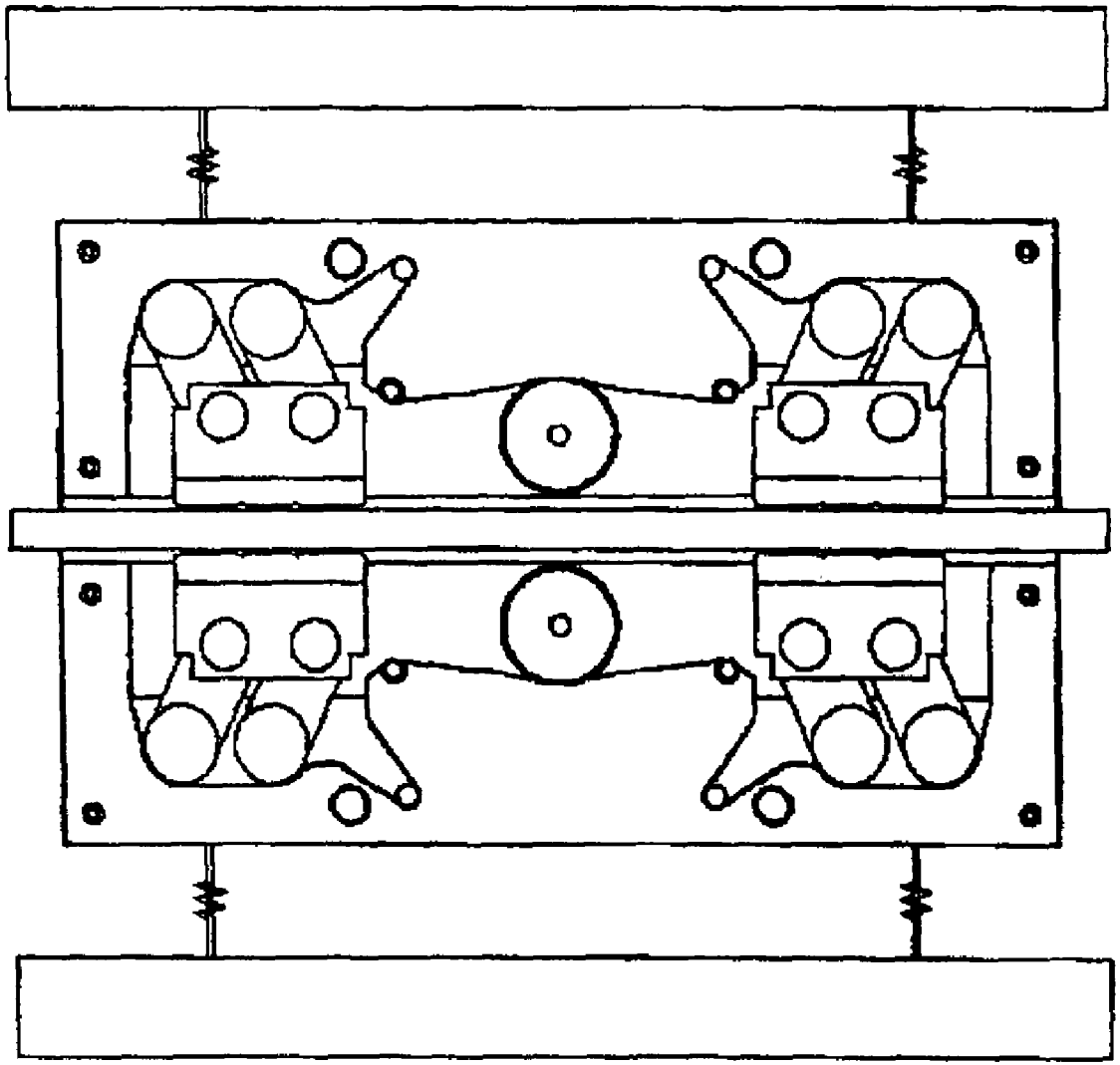
FIG. 3 shows an alternative embodiment based exclusively on the use of hinged rectangular frames.

FIG. 3 shows an alternative embodiment where the second set of fixed shoes shown in FIG. 1*b* is replaced with an arrangement containing mobile shoes having hinged rectangular frames, which is the same as that shown in FIG. 1*b*.

The invention can be executed within its essence by other embodiments unlike the one given by way of example in the description, which will also be covered by the protection sought. Likewise, it may be constructed in any shape and size and with the most suitable materials, all of this being included within the spirit of the claims.

The invention claimed is:

1. A gradual catch system for a bi-directional movable safety device, comprising:

two hinged rectangular frames, one hinged rectangular frame positioned above a roller and the other hinged rectangular frame positioned below the roller with both hinged rectangular frames positioned on a same side of a guide rail to be braked, each hinged rectangular frame being provided with a mobile brake shoe; and two fixed brake shoes positioned on an opposite side of the guide rail as that of the two hinged rectangular frames and opposed to the mobile brake shoes.

2. The gradual catch system for a bi-directional movable safety device according to claim 1, wherein each hinged rectangular frame is formed by a base of the mobile brake shoe, the base of the mobile brake shoe includes a mounted friction element and pins, the pins hinge one end of a rotation cam with an other end of the rotation cam joined to rotation hinges.

3. A gradual catch system for a bi-directional movable safety device, comprising:

a first set of two hinged rectangular frames, one hinged rectangular frame positioned above a first roller and the other hinged rectangular frame positioned below the first roller with both hinged rectangular frames of the first set positioned on a first side of a guide rail to be braked, each hinged rectangular frame of the first set being provided with a mobile brake shoe; and a second set of two hinged rectangular frames positioned on a second, opposite side of the guide rail to be braked, and opposed to the first set of two hinged rectangular frames, the second set of two hinged rectangular frames including one hinged rectangular frame positioned above a second roller and the other hinged rectangular frame positioned below the second roller with both hinged rectangular frames of the second set positioned on the second, opposite side of the guide rail to be braked, each hinged rectangular frame of the second set being provided also with a mobile brake shoe.

* * * * *